US006012302A

United States Patent [19]

Hurwitz et al.

[11] Patent Number: 6,012,302

[45] Date of Patent: Jan. 11, 2000

[54] JEWELRY ASSEMBLY WITH STONES ON SIDEWALLS OF SETTING

[75] Inventors: Robert Hurwitz, Ridgewood, N.J.; Maria Canale, New York, N.Y.

[73] Assignee: Sandberg & Sikorski Diamond Corp., New York, N.Y.

[21] Appl. No.: 09/136,340

[22] Filed: Aug. 19, 1998

Related U.S. Application Data

[60] Provisional application No. 60/087,756, Jun. 2, 1998.

[51] Int. Cl.[7] ..... A44C 17/02

[52] U.S. Cl. ..... 63/26; 63/15; 63/27; 63/28; D11/34; D11/91; D11/92

[58] Field of Search ..... 63/15, 26, 27, 63/28; D11/8, 34, 91, 92

[56] References Cited

U.S. PATENT DOCUMENTS

| | | | |
|---|---|---|---|
| D. 54,547 | 3/1920 | Gilsey | D11/34 |
| D. 315,698 | 3/1991 | Abraham | D11/34 |
| D. 373,969 | 9/1996 | Ambar | D11/34 |
| D. 393,227 | 4/1998 | Roemer | D11/34 |
| D. 412,681 | 8/1999 | Canale | D11/92 |
| 1,205,113 | 11/1916 | Selmeier | 63/27 X |
| 1,308,011 | 6/1919 | Gilsey | 63/26 |
| 5,664,440 | 9/1997 | Roemer | 63/15 |
| 5,868,008 | 2/1999 | Yamaura et al. | 63/15 |

*Primary Examiner*—Terry Lee Melius
*Assistant Examiner*—Andrea Chop
*Attorney, Agent, or Firm*—Gottlieb, Rackman & Reisman, P.C.

[57] ABSTRACT

A jewelry assembly having stones on the sidewalls of a setting is provided. The jewelry assembly includes a jewelry element, such as a ring, earring, bracelet or necklace. The assembly also includes at least one top stone having a table portion, girdle and a depending tapered portion. The top stone is attached to the jewelry element by means of a plurality of prongs depending from the element. Retaining elements are located alongside the tapered portion of the top stone and fixedly receive one or more side stones, creating an overall unique visual effect.

13 Claims, 3 Drawing Sheets

JEWELRY ASSEMBLY WITH STONES ON SIDEWALLS OF SETTING

This application claims benefit of U.S. Provisional Application No. 60/087,756 filed Jun. 2, 1998.

BACKGROUND OF THE INVENTION

This application describes a jewelry assembly, and more particularly, a jewelry assembly having a setting for a jewelry stone with other stones disposed on the sidewalls of the setting.

A conventional setting for diamonds and other precious and semi-precious stones generally comprises a conventional "box" setting in which a plurality of prongs are used to hold the diamond or other stone. A jewelry assembly which incorporates a diamond or other stone set in a conventional fashion has the table of the stone visible from the top. However, from the sides, the only element of the stone which is visible is the depending tapered portion, which is obviously less attractive than the table of the stone.

Accordingly, it would be desirable to provide a jewelry article with stones disposed along the sides of the setting of the main jewelry stone, thereby providing an improved overall jewelry design.

SUMMARY OF THE INVENTION

Generally speaking, in accordance with the invention, a jewelry assembly having stones on the sidewalls of a setting is provided. The jewelry assembly includes a jewelry element, such as a ring, earring, bracelet or necklace. The assembly also includes at least one top stone having a table portion, girdle and a depending tapered portion. The top stone is attached to the jewelry element by means of a plurality of prongs depending from the element, thereby defining a stone setting.

Significantly, the assembly also includes at least one retaining element disposed on the side of the tapered portion of the top stone and between adjacent pairs of prongs. The retaining element is sized for fixedly receiving a jewelry stone whose design and appearance is complementary to the design and appearance of the top stone.

In a preferred embodiment, a pair of metal tubings are fixedly disposed on opposite sides of the tapered portion of the top stone and between opposite pairs of prongs. The tubings receive a pair of smaller stones having a round or other shaped stone fixedly received therein.

In any embodiment of the inventive jewelry assembly, the table of the top stone is visible when viewing the assembly from the top, while the tables of the side stones are visible when viewing the assembly from the side. Since both the top and side stones have designs and configurations which are complementary to one another, the overall assembly provides an enhanced visual effect.

In one embodiment, the inventive jewelry assembly is a ring in which a setting is provided on the ring for engaging a top stone, and a pair of tubings are disposed on opposite sides of the tapered portion of the top stone for fixedly receiving a pair of smaller side stones.

In another embodiment, a series of top stone settings may be arranged along the ring or other jewelry element, with each setting having one or more retaining elements for receiving any number of side stones.

Accordingly, it is an object of this invention to provide an improved jewelry design assembly.

Another object of the invention is to provide a jewelry design assembly which is aesthetically pleasing when viewed both from the top and the sides.

Yet a further object of the invention is to provide a jewelry design assembly which has an enhanced gem or stone presentation.

Still other objects and advantages of the invention will in part be obvious, and in part be apparent from the following description.

The invention accordingly comprises a jewelry design possessing the features, properties and relation of components which will be exemplified in the designs hereinafter described, and the scope of the invention will be indicated in the claims.

BRIEF DESCRIPTION OF THE DRAWINGS

For a fuller understanding of the invention, reference is made to the following description, taken in connection with the accompanying drawings, in which.

DETAILED DESCRIPTION OF THE PREFERRED EMBODIMENT

Figure 1:
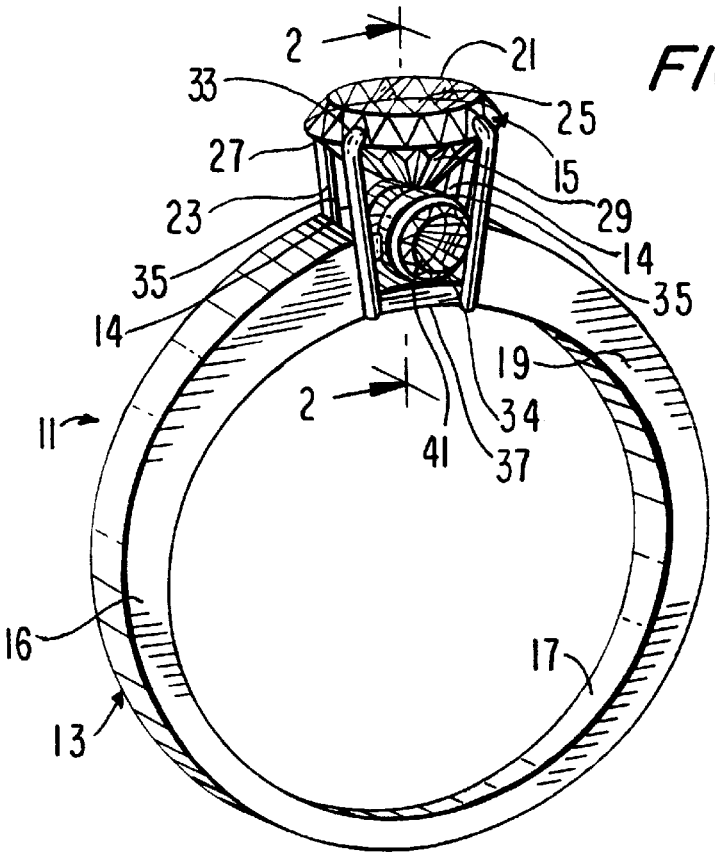
FIG. 1 is a perspective view illustrating the jewelry assembly of the invention in the form of a ring.

Referring first to FIG. 1, jewelry assembly 11, made in accordance with the invention, is shown. Jewelry assembly 11 is a ring comprising a shank portion 13 and a head portion 15. Shank 13 has an outside outer wall 16, an inside wall 17, and a pair of sidewalls 19, as is well known. Shank 13 is joined at ends 14 by a finger rest 37. Shank 13 defines an opening through which a finger of the wearer may be disposed.

Head portion 15 comprises a setting defined by four prongs 23 and a large round top stone 21 engaged within prongs 23. Top stone 21 is a diamond or other precious or semi-precious stone, and has a table portion 25, a girdle 27 and a tapered portion 29 depending from girdle 27 and leading to a culet 31 (see FIG. 2), as is well known. Each of prongs 23 fixedly and upwardly depends from finger rest 37 and each is formed at its topmost end with a bearing 33 for engaging girdle 27 of stone 21, as shown in FIG. 1.

Figure 2:
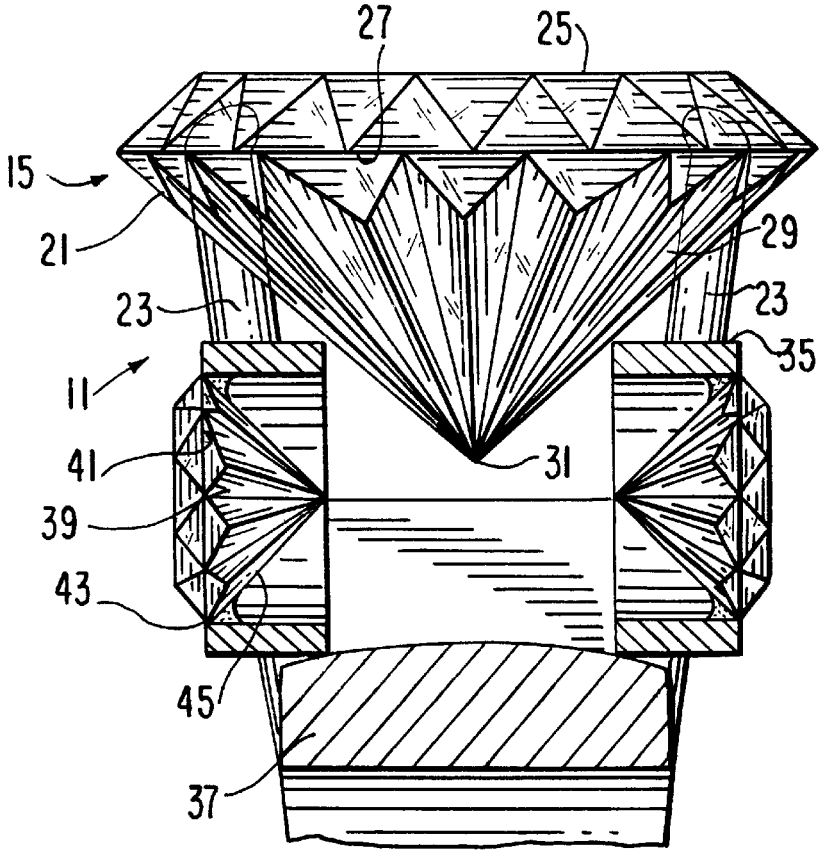
FIG. 2 is a side view in partial cross-section of the ring assembly depicted in FIG. 1.

As shown in FIGS. 1 and 2, assembly 11 further includes a pair of retaining elements in the form of tubings 35 located on opposite sides of tapered portion 29 of stone 21, and just above finger rest 37 of shank 13. In particular, each of tubings 35 fixedly sits on finger rest 37 and is fixed to and disposed between adjacent pairs of prongs 23, as shown in FIG. 1. Each of tubings 35 receives a smaller round side stone 39. Each of stones 39 includes a table 41, a girdle 43 and a tapered portion 45. As shown in FIG. 2, the inside walls of each of tubings 35 grabs girdle 43 of each of stones 39 in order to capture stones 39 in position along the sides of the jewelry setting. In position, tables 41 of each of stones 39 extend just past the front edge of tubings 35 and are fully visible from the sides.

In order to manufacture the jewelry assembly of the invention, a model of the assembly is first prepared about which a rubber mold is disposed. Then, the model is removed from the rubber mold, after which wax is injected into the cavity of the rubber mold in order to create a wax form of the assembly. Then, the wax is separated from the rubber mold, and is itself cast into gold or platinum, as is well known in the art.

Once standard preparation steps are carried out on the cast piece, such as cleaning and pre-polishing, the settings are prepared for reception of both side stones 39 and top stone 21. Side stones 39 are first mounted within tubings 35, and then top stone 21 is mounted in prongs 23. The jewelry piece is then polished as part of the final finishing process.

An alternative manufacturing process comprises placing the side stones 39 into the mold, after which wax is injected around the side stones, holding the stones in place. Casting then proceeds as described in the previous paragraph.

Figure 3:
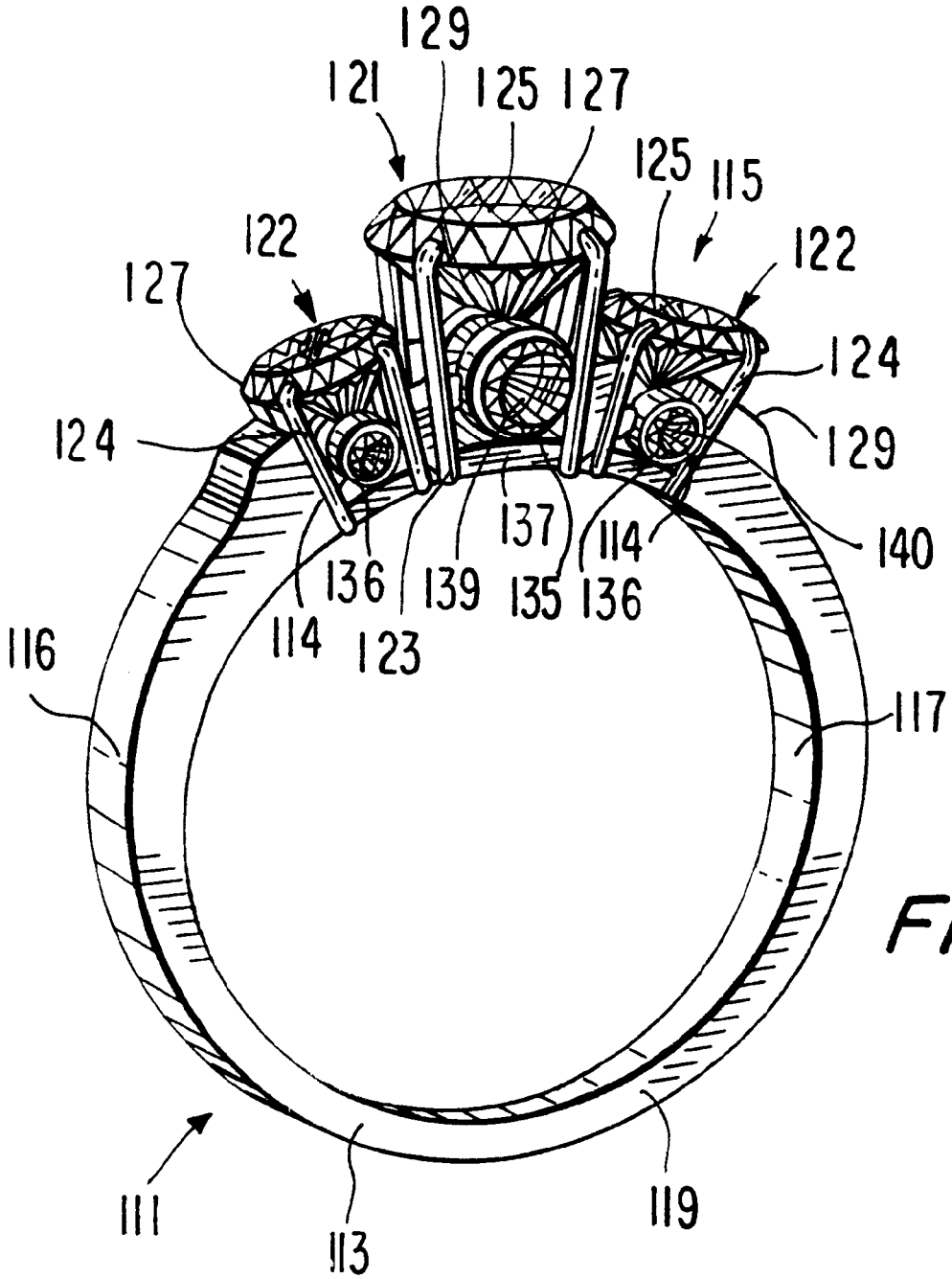
FIG. 3 is a perspective view of a second embodiment of a jewelry assembly of the invention in the form of a ring.

Referring now to FIG. 3, a second embodiment of the jewelry assembly is generally indicated at 111. Jewelry assembly 111 is also a ring comprising a shank 113 and a head portion 115. Shank 113 has an outside wall 116, an inside wall 117, and a pair of side walls 119. Shank 113 is joined at ends 114 by a finger rest 137. Shank 113 defines an opening through which a finger of the wearer may be disposed.

Head portion 115 defines a series of settings and consists of a first larger round top stone 121 engaged within prongs 123, and a pair of smaller round top stones 122 disposed on either side of round top stone 121 and also engaged within four prongs 124. Each set of prongs 123 and 124 are fixed to and depend upwardly from finger rest 137, as shown in FIG. 3. Each of top stones 121 and 122 has a table portion 125, a girdle 127 and a tapered portion 129. Each of prongs 123 and 124 engage girdles 127 of top stone 121 and 122, as shown.

Like the embodiment of FIGS. 1 and 2, each of the settings of top stones 121 and 122 includes a pair of tubings 135 and 136 respectively, located on opposite sides of tapered portions 129 and fixedly sitting on finger rest 137. Each of tubings 135 and 136 receives smaller round stones 139 and 140 respectively, such that the table portions thereof are visible from the sides of jewelry assembly ill. As before, the inside walls of each of tubings 135 and 136 grab the girdle portions of each of stones 139 and 140 in order to fix the stones in position.

Figure 4:
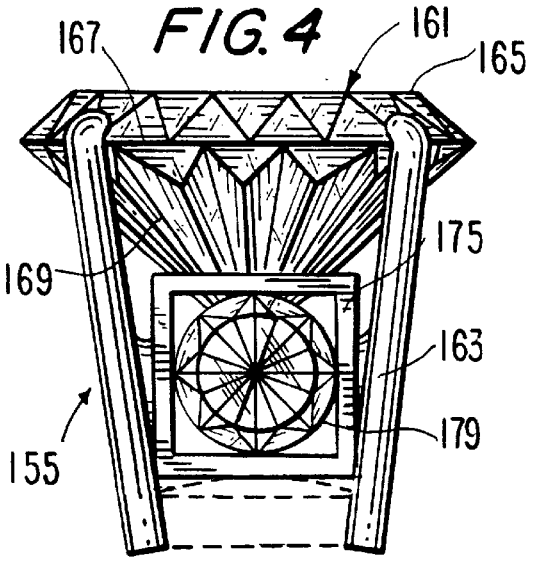
FIG. 4 is a front elevational view of a third embodiment of a jewelry assembly of the invention.
Figure 5:
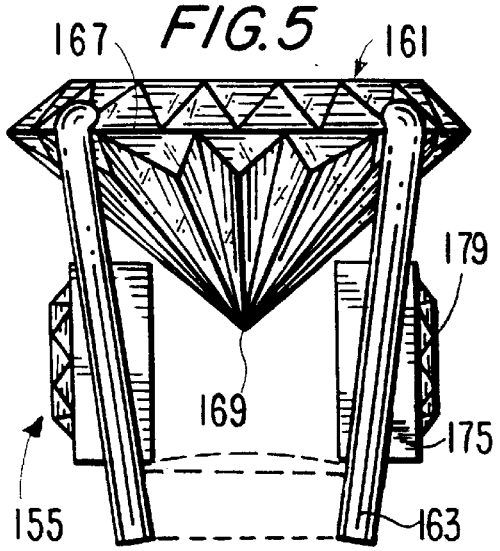
FIG. 5 is a side elevational view of the assembly depicted in FIG. 4.

Referring now to FIGS. 4 and 5, an alternative design for the head portion of the inventive jewelry design is shown and generally indicated at 155. Head portion 155 consists of a large round top stone 161 engaged within a series of prongs 163. Top stone 161 has a table portion 165, a girdle 167 and a tapered portion 169 depending from girdle 167. As before, each of prongs 163 has a bearing at its top end for engaging girdle 167 of stone 161.

Head portion 155 of the assembly depicted in FIGS. 4 and 5 includes a pair of square-shaped retaining elements 175 disposed on opposite sides of tapered portion 169 of stone 161, and between adjacent prongs 163. Each of retaining elements 175 receives a smaller round side stones 179. As shown, the inside walls of each of retaining elements 175 grab the girdle portion of each of stone 179 in order to fix the stones in position.

Figure 6:
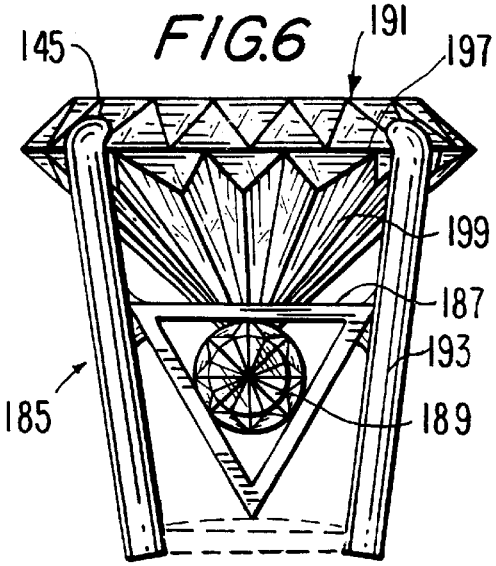
FIG. 6 is a front elevational view of a fourth embodiment of the jewelry assembly of the invention.
Figure 7:
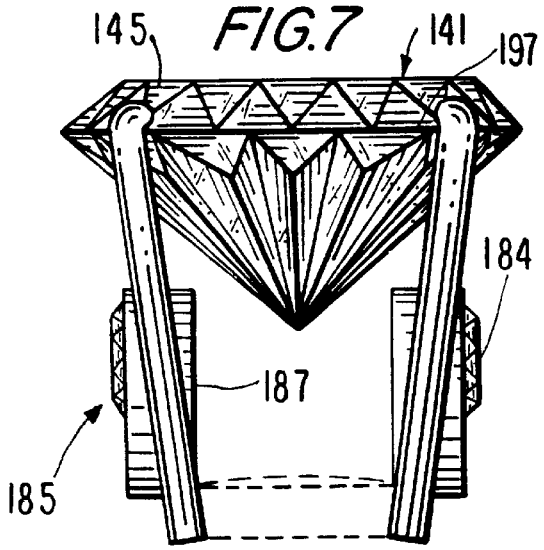
FIG. 7 is a side elevational view of the assembly depicted in FIG. 6.

Referring now to FIGS. 6 and 7, a further design of the head portion of the inventive jewelry assembly is described and generally indicated at 185. Head portion 185 includes a large round top stone 191 engaged within prongs 193, as shown. Top stone 191 has a table portion 195, a girdle 197 and a tapered portion 199 depending from girdle 197. Each of prongs 193 has bearings at its top end for engaging girdle 197 of stone 191.

Head portion 185 of the inventive assembly depicted in FIGS. 6 and 7 features a pair of side retaining elements having a triangular shaped design and disposed on opposite sides of tapered portion 199 of stone 191 and between adjacent prongs 193. Each of retaining elements 187 receives a smaller round side stone 189—as before, the inside walls of each of retaining elements 187 grab the girdle portions of stones 189 in order to fix the stones in position.

Although the various embodiments of the inventive jewelry assembly are shown with respect to rings, the design is also applicable for earrings, bracelets, pendants, necklaces, and other jewelry items.

Although both the top and side stones in the various embodiments illustrated are round stones, other shaped stones, such as square, pear, marquise and oval, may be used without departing from the spirit and scope of the invention.

As can be appreciated, diamonds, rubies, emeralds or other precious and semi-precious jewelry stones may be used in the inventive assembly.

It will thus be seen that the objects set forth above, among those made apparent from the preceding description, are efficiently attained, and, since certain changes may be made in the described design and the construction set forth, without departing from the spirit and scope of the invention, it is intended that all matter contained in this description and shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

We claim:

1. A jewelry assembly comprising:

a jewelry element;

a setting comprising a top jewelry stone having a table visible from above said jewelry element and a depending tapered portion, and being attached to said jewelry element by means of a plurality of prongs depending up from said jewelry element;

said setting further including a retaining element positioned alongside and underneath said tapered portion of said top stone and between a pair of said plurality of prongs that are adjacent one another, said retaining element touching at least a portion of said jewelry element;

a jewelry side stone received by said retaining element and being part of said setting, and having a table that is substantially perpendicular to the table of the top stone, said side stone having a design that is complementary to that of said top stone, and being disposed partially underneath the tapered portion of said top stone.

2. The assembly of claim 1, wherein said jewelry element is selected from the group consisting of a ring, an earring, a bracelet, a pendant and a necklace.

3. The assembly of claim 1, wherein said top stone has a girdle from which said tapered portion depends.

4. The assembly of claim 3, wherein each of said plurality of prongs includes a bearing for engaging the girdle of said top stone.

5. The assembly of claim 1, wherein said top stone has a stone design selected from the group consisting of round, square, oval, marquise and pear.

6. The assembly of claim 1, wherein said retaining element is tubular in design.

7. The assembly of claim 1, wherein said jewelry side stone includes a girdle and said retaining element has an inside wall which grabs the girdle of said side stone in order to fix said side stone in position in said retaining element.

8. A ring assembly comprising:

a ring:

a setting comprising a top stone having a table portion facing substantially up, a girdle and a tapered portion depending from said girdle, said stone being mounted to the ring by means of a plurality of prongs upwardly depending from said ring;

said setting further including a tubing member transversely disposed alongside and underneath said tapered portion of said top stone and between a pair of said plurality of prongs that are adjacent to one another, said tubing member touching at least a portion of said ring;

a jewelry side stone received by said tubing member having a table portion facing in a direction substantially perpendicular to said top stone, and whose design is complementary to that of said top stone, said side stone being disposed partially underneath said tapered portion of said top stone.

9. The assembly of claim 8, wherein said ring comprises a shank and a finger rest.

10. The assembly of claim 9, wherein said plurality of prongs depend from said finger rest.

11. The assembly of claim 8, wherein each of said plurality of prongs includes a bearing for engaging said girdle of said top stone.

12. The assembly of claim 8, wherein said side stone is round in configuration.

13. The assembly of claim 8, wherein said side stone has a girdle and said tubing member has an inside wall which grabs said girdle of said side stone in order to fix said side stone in said member.

* * * * *